US007037154B1

(12) United States Patent
Suzuki

(10) Patent No.: US 7,037,154 B1
(45) Date of Patent: May 2, 2006

(54) METHOD FOR FIXING OR REMOVING SURFBOARD FIN, AND SURFBOARD FIN

(76) Inventor: Tadashi Suzuki, 3-9-20 Nakakaigan, Chigasaki City, Kanagawa Prefecture (JP)

( * ) Notice: Subject to any disclaimer, the term of this patent is extended or adjusted under 35 U.S.C. 154(b) by 0 days.

(21) Appl. No.: 11/012,736

(22) Filed: Dec. 16, 2004

(51) Int. Cl.
*B63B 1/00* (2006.01)

(52) U.S. Cl. ..... 441/79; 441/74

(58) Field of Classification Search ..... 441/74, 441/79

See application file for complete search history.

(56) References Cited

U.S. PATENT DOCUMENTS 3,585,663 A * 6/1971 Johnson ..... 441/79
3,659,300 A * 5/1972 Johnson ..... 441/79
4,421,492 A * 12/1983 Leva ..... 441/79
5,176,553 A * 1/1993 Tuttle ..... 441/79

* cited by examiner

*Primary Examiner*—Lars A. Olson
(74) *Attorney, Agent, or Firm*—Jacobson Holman PLLC

(57) ABSTRACT

The surfboard fin, in particular, a long surfboard fin has been fixed to or removed from the surfboard under application of a washer and a screw. This operation is quite inconvenient and the fin is removed or fixed when the surfboard is used or is not used, resulting in that the prior art fin has required a quite amount of labor for it. The present invention enables this operation to be carried out manually in an easy manner. The box is fixed to a groove formed at the surfboard with adhesive agent and then the inside part of the box is formed with two grooves standing at different levels. The front long groove is positioned at a slight higher location and one pin of the fin can be inserted into the groove. The rear part pin can be inserted into several L-shaped grooves arranged at a slight lower part of the rear part of the box. The fin has a slight higher front part, has a step and the rear part is positioned at a slight lower location and the front part and the rear part have a total number of two pins each of which is set at the front part and the rear part, respectively. With such an arrangement as above, the fin can be fixed by fitting the two pins into both grooves and the troublesome fixing or removing operation of the fin can be overcome.

2 Claims, 4 Drawing Sheets

METHOD FOR FIXING OR REMOVING SURFBOARD FIN, AND SURFBOARD FIN

BACKGROUND OF THE INVENTION

1. Field of the Invention

This invention relates to a method for fixing or removing a surfboard fin or the like, and to a surfboard fin.

2. Description of the Prior Art

A surfboard fin is fixed when it is used, and removed when it is not used because if the fin is not removed when the fin is not used, it produces an inconvenient state during transportation of the surfboard and the like. Although certain screws are used for its fixing or removing, a surfboard playing person feels much amount of inconvenience for this work. In addition, the fin for a long surfboard, a so-called long board is fixed or released in particular under application of bolts and washers.

[Patent Document 1] No specific prior art document

[Non-patent Document 1]

All the surfboard fins described in a surfing magazine and the like are fixed or removed through screws.

SUMMARY OF THE INVENTION

It is an object of the present invention to provide a method capable of manually and easily fixing a fin to or removing a fin from a surfboard without using any screws, and to provide the fin.

This invention relates to a method for fixing or removing a surfboard fin or the like in which a box is adhered to a groove formed at the surfboard with adhesive agent, the inside part of the box has a long groove at a front slight higher location, several L-shaped grooves are arranged at the rear side, the fin is provided with one pin at a slight upper location of the front part of a base portion and further provided with another pin at a slight lower location of the rear part of the base portion, the front side pin is fitted to the long groove and the rear side pin is fitted to the L-shaped groove, and the fin can be manually fixed to or removed from the surfboard, and further this invention relates to a surfboard fin and the like in which a pin at an upper level is arranged at the front side of the base portion of the fin and a pin at a lower level is arranged at the rear side of it.

Since no screw is used for the method for fixing a fin to or removing the fin from a surfboard and the like, its labor for this work can be remarkably reduced. Further, three fins are fixed to one surfboard, so that the prior art method using screws up to now has been quite troublesome in operation. However, the method of the present invention enables the fins to be manually and easily fixed or removed. Additionally, the fins are also simple in configuration and easily operated, and they are quite convenient.

DETAILED DESCRIPTION OF THE PREFERRED EMBODIMENT

Figure 1:
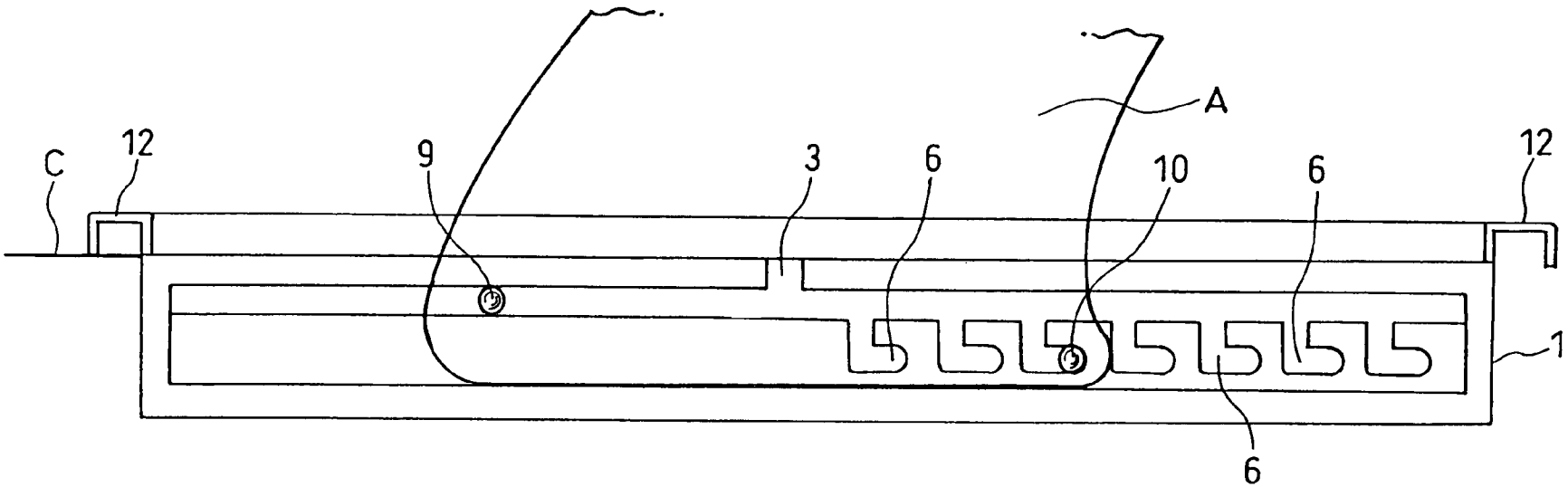
FIG. 1 is a side elevational view.
Figure 2:
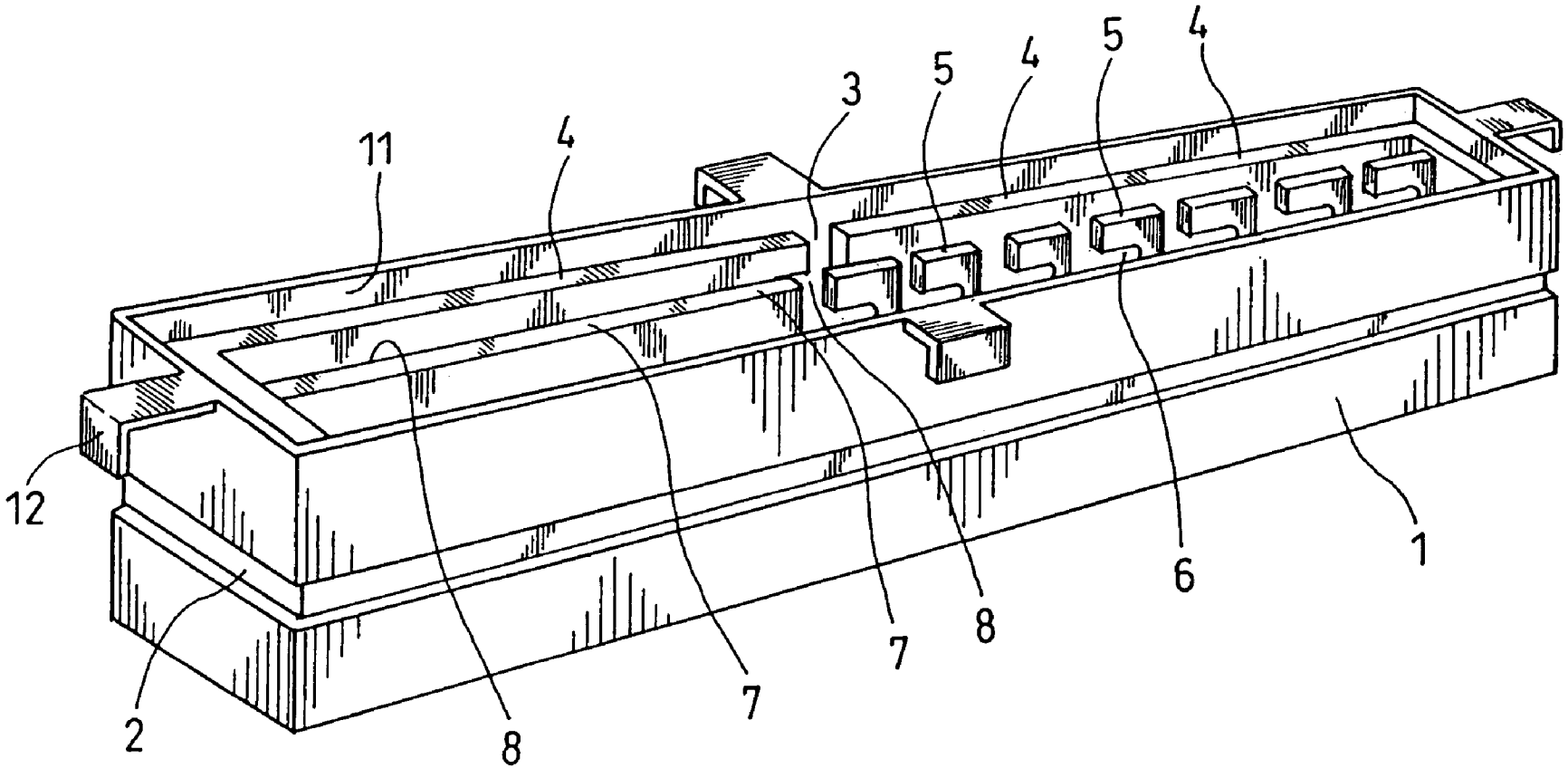
FIG. 2 is a perspective view.
Figure 3:
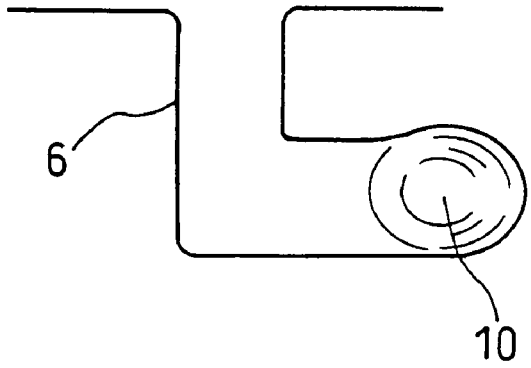
FIG. 3 is a side elevational view for showing an L-shaped groove.
Figure 4:
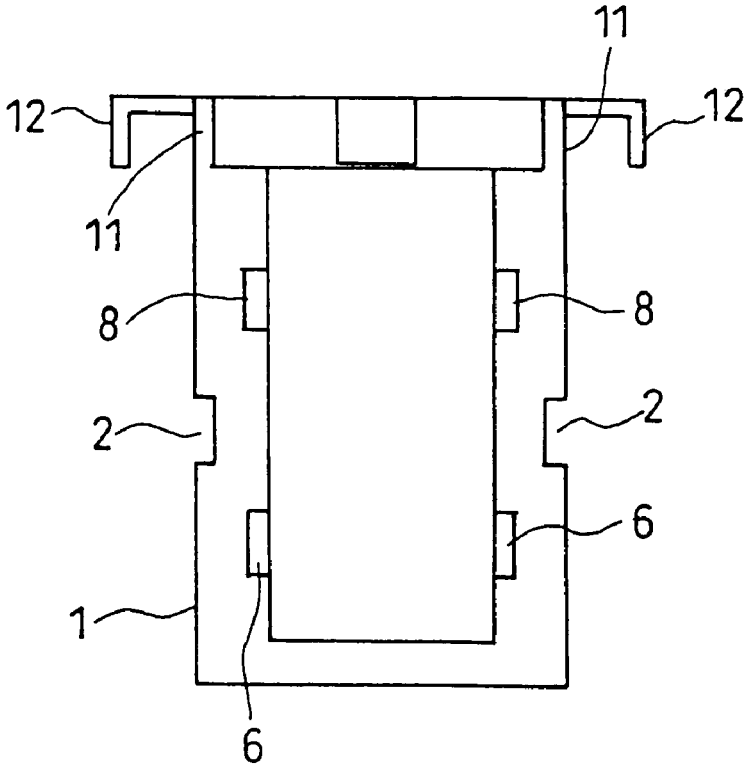
FIG. 4 is a sectional view.
Figure 5:
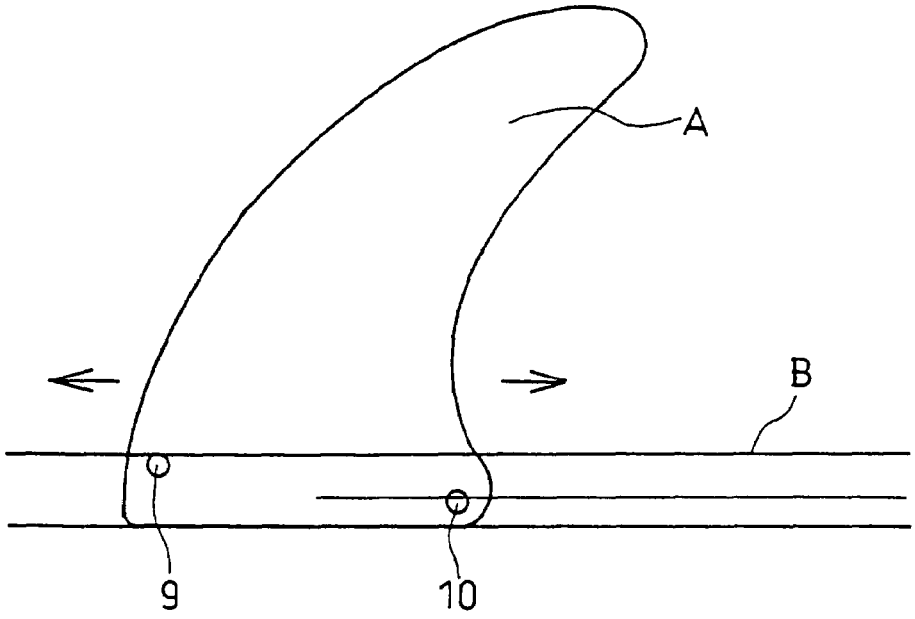
FIG. 5 is a side elevational view for showing a fin.

A box 1 is provided, and grooves 2 for adhesive agent are arranged at side surfaces of the box 1. The box is used such that a longitudinal groove is formed at the surfboard and the box is adhered to the groove. The groove 2 is used for making a superior contacted state of the adhesive agent. The inside part of the box has a guiding groove 3 at its central part in a longitudinal direction and there are provided a first flat surface part 4 and a second flat surface part 5 slightly lower than the first flat surface part.

The second flat surface part 5 has, in a backward direction, seven to several L-shaped grooves 6 extending in a downward direction and then advancing in a rearward direction.

No groove is formed at the front flat surface part 7. However, the lower part of the first flat surface part 4 is formed with a longitudinal groove 8.

A front upper pin 9 and a rear lower pin 10 protrude at the base part of the fin A. The front upper pin 9 protrudes at a slight upper position of the front part of the fin, and the rear lower pin 10 protrudes at a slight rear lower position.

In its operation, when the pin of the fin A is set into the guiding groove 3 and the pin is moved in a forward or rearward direction, the front upper pin 9 enters the longitudinal groove 8 at first, the rear lower pin 10 is fitted into the L-shaped groove, whereby both pins are fixed. The rear lower pin can be set in any of several L-shaped grooves 6.

The first flat surface part 4 has a wall 11, and a horizontal state keeping part 12 is attached to the wall 11. This wall 11 is arranged so as to prevent the adhesive agent from entering the surfboard hole when the box 1 is fixed in the surfboard hole, and is scraped off after the box is fixed in the hole. In addition, the horizontal state keeping part 12 keeps the same level as that of the surface of the surfboard when the box 1 is fixed in the hole, and has an L-shape, and its extremity end keeps a horizontal state while being in contact with the surface of the surfboard. This will be also cut off afterwards.

All the portions above a line C are cut off and so the surface of the surfboard becomes horizontal and smooth after completion.

The fin is also unique, has a simple configuration, uses only two pins standing on different levels, so that the fin can be easily used.

Figure 6:
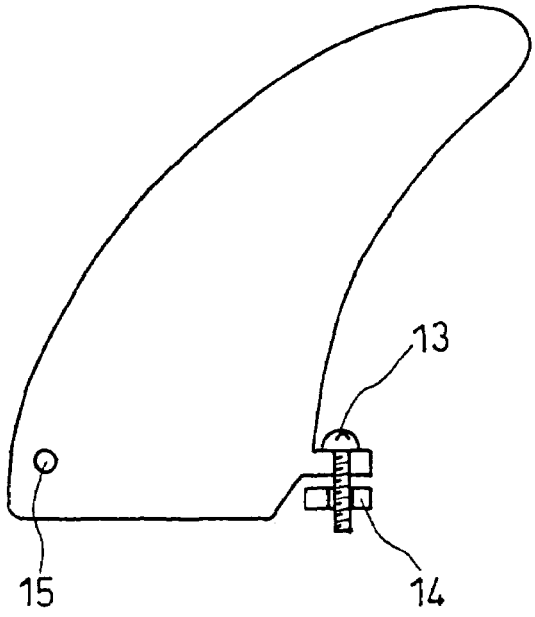
FIG. 6 is a side elevational view for showing the prior art.

Reference numeral 13 in FIG. 6 denotes the prior art screw, reference numeral 14 denotes a washer, and reference numeral 15 denotes a pin.

The fin which has been fixed to or removed from the surfboard through application of a screw and a washer can be manually fixed to or removed from the surfboard in an easy manner and so its applicability is widely set on a global base.

What is claimed is:

1. A method for fixing or removing a surfboard fin, said method comprising the steps of adhering a box to a groove formed in a surfboard, an inside part of the box having a long groove at a front location and several L-shaped grooves arranged at a rear location, providing a fin with one pin at a slight upper location of a front part of a base portion and further providing another pin at a slight lower location of the rear part of the base portion, and fitting the front side pin in the long groove and fitting the rear side pin to one of the L-shaped grooves so that the fin can be manually fixed to or removed from the surfboard.

2. A combination of a surfboard and a surfboard fin said combination comprising a first pin at an upper level arranged at a front side of a base portion of the fin, a second pin at a lower level arranged at a rear side of the base portion of the fin, and a box adhered to a groove formed in the surfboard, an inside part of the box having a long groove at a front location and several L-shaped grooves arranged at a rear location, said first pin fitting in the long groove and the second pin fitting in one of the L-shaped grooves for manually fixing and removing the fin to and from the surfboard.

* * * * *